US006847346B2

(12) United States Patent
Kumagai et al.

(10) Patent No.: US 6,847,346 B2
(45) Date of Patent: Jan. 25, 2005

(54) SEMICONDUCTOR DEVICE EQUIPPED WITH TRANSFER CIRCUIT FOR CASCADE CONNECTION

(75) Inventors: Masao Kumagai, Kawasaki (JP); Shinya Udo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 288 days.

(21) Appl. No.: 10/278,883

(22) Filed: Oct. 24, 2002

(65) Prior Publication Data

US 2003/0103390 A1 Jun. 5, 2003

(30) Foreign Application Priority Data

Nov. 30, 2001 (JP) ..... 2001-367833

(51) Int. Cl.[7] ..... G09G 3/36
(52) U.S. Cl. ..... 345/98; 345/100; 712/11
(58) Field of Search ..... 345/98, 100, 204, 345/205; 712/10, 11, 16, 32

(56) References Cited

U.S. PATENT DOCUMENTS 5,671,432 A * 9/1997 Bertolet et al. ..... 712/11
5,848,289 A * 12/1998 Studor et al. ..... 712/32
6,385,635 B1 * 5/2002 Ishii ..... 708/603
2002/0114415 A1 * 8/2002 Lee et al. ..... 375/354
2003/0231734 A1 * 12/2003 Fujita et al. ..... 377/64

FOREIGN PATENT DOCUMENTS

JP 2001-202052 7/2001

* cited by examiner

*Primary Examiner*—Amare Mengistu
(74) *Attorney, Agent, or Firm*—Arent Fox PLLC

(57) ABSTRACT

A transfer circuit 25 includes two sets of an input circuit 52A and an output circuit 53B, which allows bidirectional transfer. The input circuit 52A decomposes external input data signals DI11A and DI12A to signals on lines L11 to L14 in synchronism with a clock signal CLK in order to reduce the frequency thereof. The output circuit 53B composes the decomposed signals in synchronism with the clock signal CLK to regenerate the original signals and output them as external output data signals DO11B and DO12B. Signals on either the lines L11 to L14 or L21 to L24 are selected by a multiplexer 57 to provide to a main body circuit.

20 Claims, 12 Drawing Sheets

SEMICONDUCTOR DEVICE EQUIPPED WITH TRANSFER CIRCUIT FOR CASCADE CONNECTION

BACKGROUND OF THE INVENTION

1. Field of the Invention

The present invention relates generally to a semiconductor device equipped with a transfer circuit receiving an external input data signal and providing a retimed signal thereof as an external output data signal in order to make a cascade connection of a plurality of semiconductor devices, more particularly to a data driver IC to be mounted on a flat-panel display device.

2. Description of the Related Art

FIG. 11 is a block diagram showing a schematic configuration of a conventional data driver 20 that is connected to the data lines of an LCD panel 10.

The data driver 20 includes a plurality of data driver ICs 21 to 24 having the same structure that are mounted on a printed board and commonly connected to lines for providing clock signals CLK and data signals DATA. Therefore, lines parallel to the longitudinal direction of the data driver 20 and lines perpendicular thereto must be formed on the printed board, and the printed board has two wiring layers. In practical, because there is a need to form other signal lines and power supply lines on the printed board, it has six wiring layers, increasing the cost of the printed board.

FIG. 12 is a schematic block diagram showing a data driver 20A that employs a cascade connection in order to overcome such a problem.

In this data driver 20A, each of data driver ICs 21A to 24A is provided with input and output terminals for the data signals DATA and the clock signal CLK, and the input and output terminals are connected through a buffer circuit within the data driver IC 21A. According to this configuration including such a signal transfer section in each IC, cascade connections of the data driver ICs 21A to 24A are made with respect to the data signals DATA and the clock signal CLK, so that there is no intersection between the lines on the printed board, and the printed board has only one wiring layer. In practical, because other signal lines and power supply lines are additionally provided, it has two wiring layers. This allows reducing the cost of the printed board. When such a signal transfer section is formed in each data driver IC, although the cost partially increases due to the increase of chip area, the total cost of the data driver ICs and the printed board can be reduced.

However, since the distance between adjacent lines inside the chip is much smaller than that on the printed board, crosstalk noise between signal lines becomes not negligible. Particularly, in a case where the data driver 20A is connected to a high resolution LCD panel, because the frequency of data signals DATA is relatively high, the crosstalk effect increases. In addition, because an external signal line L1 is longer than an internal signal line L3, their signals have different propagation delay times due to difference of line capacity. Due to the cascade connection between the data driver ICs 21A to 24A, the delay time differences are accumulated, making the timing adjustment difficult.

To resolve these problems, JP 2001-202052-A discloses a semiconductor device comprising a signal transfer circuit which decomposes inputted external input data signals to reduce the frequency thereof, transfers the decomposed signals, combines them to compose the retimed signals of the external input data signals, and outputs the retimed signals.

However, since the transfer direction is fixed, according to whether the semiconductor devices as data driver ICs are disposed along one side or the opposite side of a flat display panel, two kinds of semiconductor devices are required.

If bidirectional transfer circuit is incorporated into the semiconductor device, the wiring area of the signal transfer circuit increases because of the decomposition.

SUMMARY OF THE INVENTION

Therefore, it is an object of the present invention to provide a semiconductor device which can be mounted on any side of a flat display panel with reducing the crosstalk effect in a signal transfer section, and also reducing timing difference in a case where a cascade connection is made for a plurality of integrated circuit devices.

It is another object of the present invention to provide a semiconductor device which can reduce the wiring area of the signal transfer section.

In one aspect of the present invention, there is provided with a semiconductor device comprising:

- a control terminal to receive a transfer direction control signal, a first I/O terminal, and a second I/O terminal;
- a transfer circuit configured to, when the transfer direction control signal is in a first state:
- receive an external input data signal from the first I/O terminal,
- decompose the external input data signal into first and second data signals in synchronism with a clock signal so as to reduce frequency of the external input data signal,
- combine the first and second data signals in synchronism with the clock signal to compose a retimed signal of the external input data signal, and
- provide the retimed signal as an external output data signal to the second I/O terminal,
- and further configured to, when the transfer direction control signal is in a second state:
- receive an external input data signal from the second I/O terminal,
- decompose the external input data signal into first and second data signals in synchronism with the clock signal so as to reduce frequency of the external input data signal,
- compose a retimed signal of the external input data signal on the basis of the first and second data signals in synchronism with the clock signal, and
- provide the retimed signal as an external output data signal to the first I/O terminal; and
- a main body circuit to process the external input data signal.

According to this configuration, since the transfer circuit is bidirectional, the semiconductor devices can be mounted on any side of a flat display panel. In addition, since the signal is decomposed to reduce the frequency thereof, it is possible to reduce the crosstalk effect in a signal transfer section. Moreover, since the transferred signal is a retimed signal, it is possible to reduce timing difference in a case where a cascade connection is made for the semiconductor devices.

DESCRIPTION OF THE PREFERRED EMBODIMENTS

Figure 1:
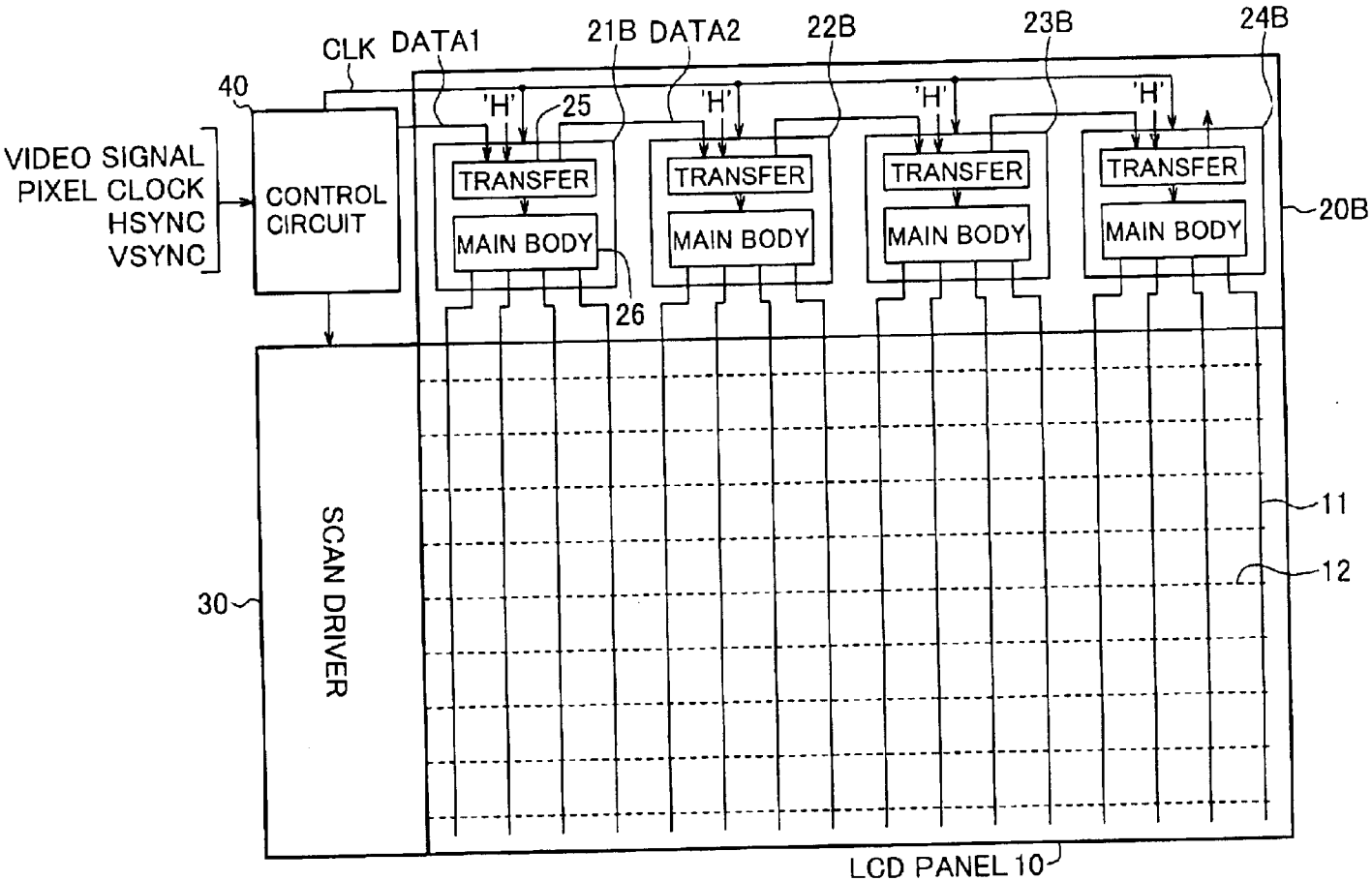
FIG. 1 is a schematic block diagram showing a liquid crystal display device according to a first embodiment of the present invention.

Hereinafter, preferred embodiments of the present invention will be described in detail referring to the drawings.

First Embodiment

FIG. 1 is a schematic block diagram showing a liquid crystal display device according to a first embodiment of the present invention.

In an LCD panel 10, a plurality of vertically extended data lines 11 and a plurality of horizontally extended scan lines 12 are formed crossing over each other, and a pixel is formed at each crossover point. One ends of the data lines 11 and the scan lines 12 are connected to a data driver 20B and a scan driver 30, respectively. Based on a video signal, a pixel clock signal, a horizontal synchronizing signal, and a vertical synchronizing signal provided from the external, a control circuit 40 provides a data signal DATA1 and a clock signal CLK to the data driver 20B, and also provides a scan control signal to the scan driver 30.

The data driver 20B includes data driver ICs 21B to 24B having the same configuration. The data driver IC 21B includes a transfer circuit 25 and a main body circuit 26, both operating in synchronism with the clock signal CLK. The transfer circuit 25 changes the transfer direction according to a transfer direction control signal R/L. That is, when R/L is high (indicated as 'H' in FIG. 1), signal transfer is made from first data signal input/output terminals to second data signal input/output terminals, and when R/L is low, the signal transfer is made in the reverse direction.

The data driver ICs 21B to 24B are cascaded with respect to the first and second data signal input/output terminals. On the other hand, the clock signal CLK is commonly provided to the data drivers ICs 21B to 25B. The transfer direction control signal R/L is fixed to high 'H' in a case of FIG. 1. The data signals being under transfer in the transfer circuit 25 are provided to the main body circuit 26, and based on the data signals, the main body circuit 26 determines pixel electrode voltages provided to data lines of the LCD panel 10 every one horizontal period.

Figure 2:
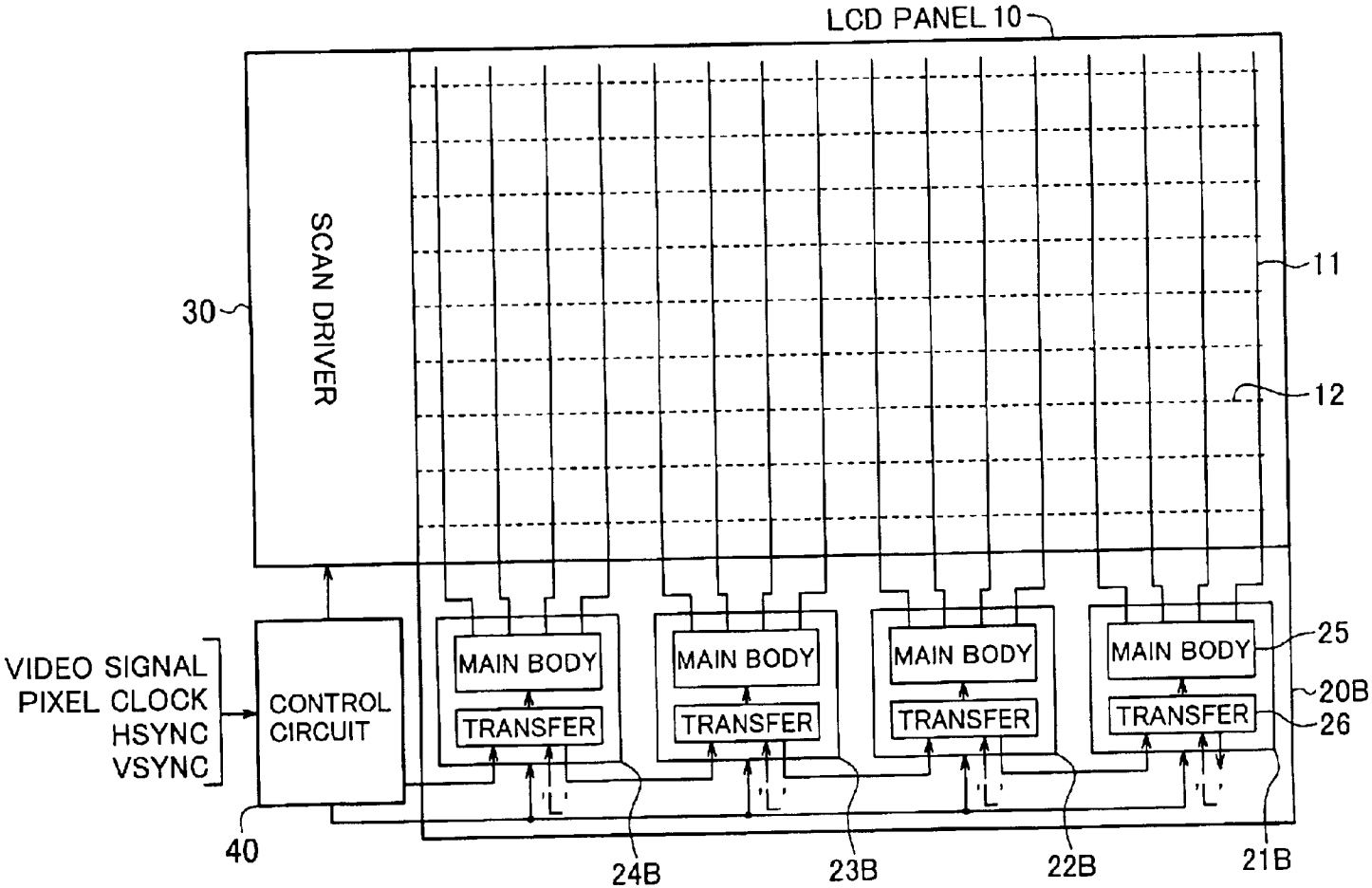
FIG. 2 is a schematic block diagram showing a liquid crystal display device in which, as compared with the case of FIG. 1, the data driver is disposed along the opposite side of the LCD panel.

FIG. 2 is a schematic block diagram showing a liquid crystal display device in which, as compared with FIG. 1, the data driver 20B is disposed along the opposite side of the LCD panel 10. The transfer direction control signal R/L provided to each main body circuit 26 is fixed to low ('L'), and the data signal DATA from the control circuit 40 is transferred in sequence from the data driver IC 24B to the data driver IC 21B. The other configurations are the same as the case of FIG. 1.

Figure 3:
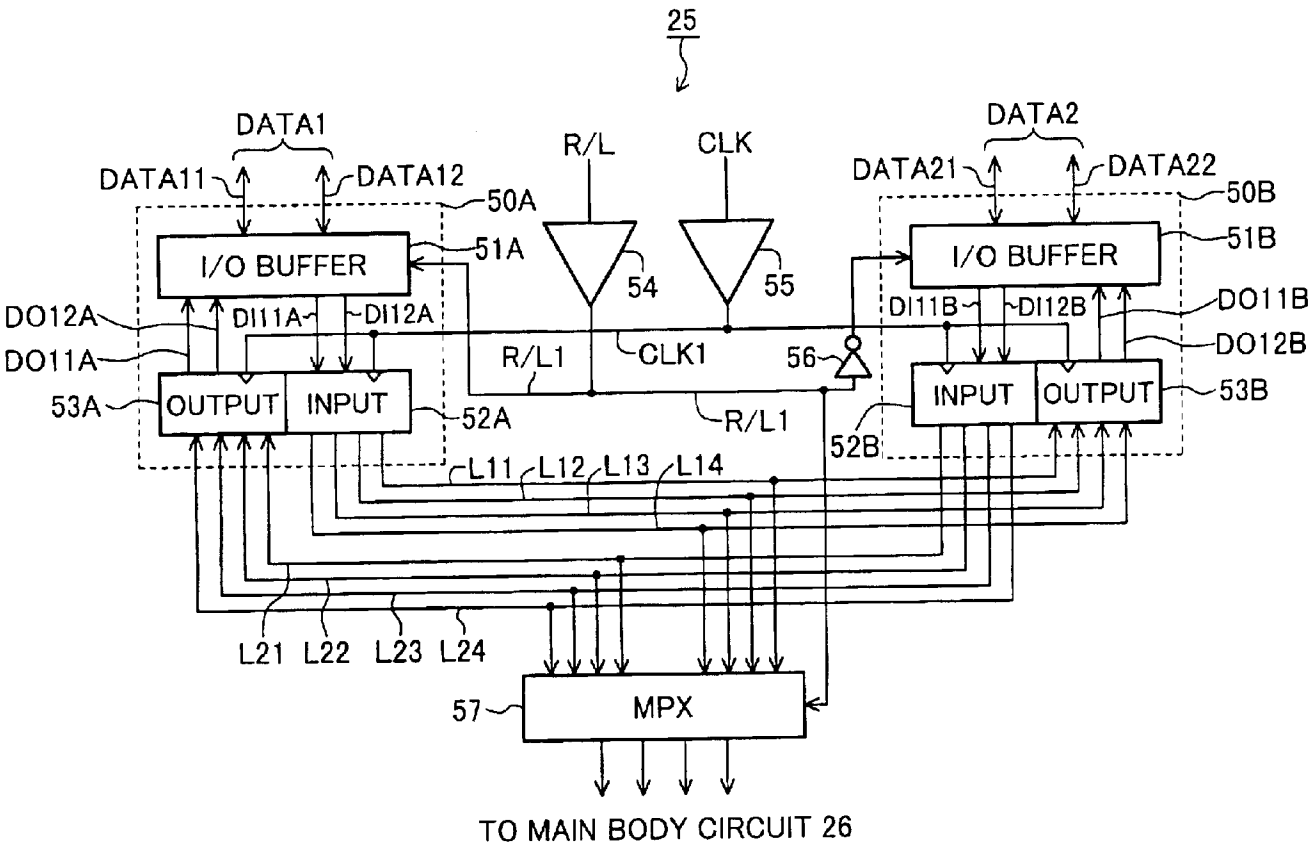
FIG. 3 is a block diagram showing an embodiment of a transfer circuit of FIG. 1.

FIG. 3 is a block diagram showing an embodiment of the transfer circuit 25 of FIG. 1. For simplification, FIG. 3 shows a case where the data signal DATA1 consists of 2 bits, DATA11 and DATA12.

As shown in FIG. 3, the transfer circuit 25 is constituted almost symmetrically, and first and second end side circuits 50A and 50B are formed on one end side and the other end side, respectively, within the data driver IC 21B of FIG. 1. In FIG. 3, corresponding elements of the first and second end side circuits 50A and 50B are denoted by like reference characters. The first end side circuit 50A includes an I/O buffer circuit 51A, an input circuit 52A, and an output circuit 53A. The control input of the I/O buffer circuit 51A receives the transfer direction control signal R/L as signal R/L1 through a buffer circuit 54, and clock inputs of the input circuit 52A and the output circuit 53A receive the clock signals CLK as signal CLK1 through a buffer circuit 55.

Figure 4:
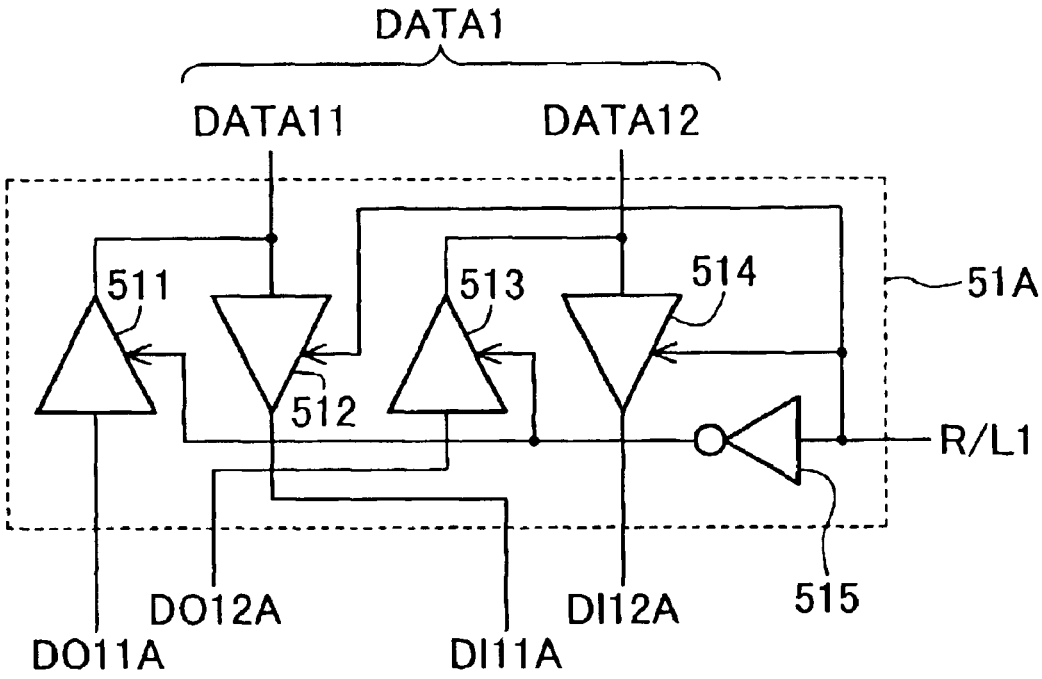
FIG. 4 is a logic circuit diagram showing an embodiment of an I/O buffer circuit of FIG. 3.

FIG. 4 is a view showing an embodiment of the I/O buffer circuit 51A.

This circuit 51A includes tristate buffer circuits 511 to 514, and an inverter 515. When the transfer direction control signal R/L1 is 'H', DATA11 and DATA12 are provided through the tristate buffer circuits 512 and 514, respectively, to the input circuit 52A of FIG. 3 as external input data signals DI11A and DI12A, while the outputs of the tristate buffer circuits 511 and 513 are in a high impedance state. When the transfer direction control signal R/L1 is low, external output data signals DO11A and DO12A from the output circuit 53A of FIG. 3 are output through the tristate buffer circuits 511 and 513 as DATA 11 and DATA 12, respectively, while the outputs of the tristate buffer circuits 512 and 514 are in a high impedance state.

As shown in FIG. 3, because the control input of the I/O buffer circuit 51B receives the transfer direction control signal R/L1 through an inverter 56, the first and second end side circuits 50A and 50B are opposite to each other in the transfer direction.

Figure 5:
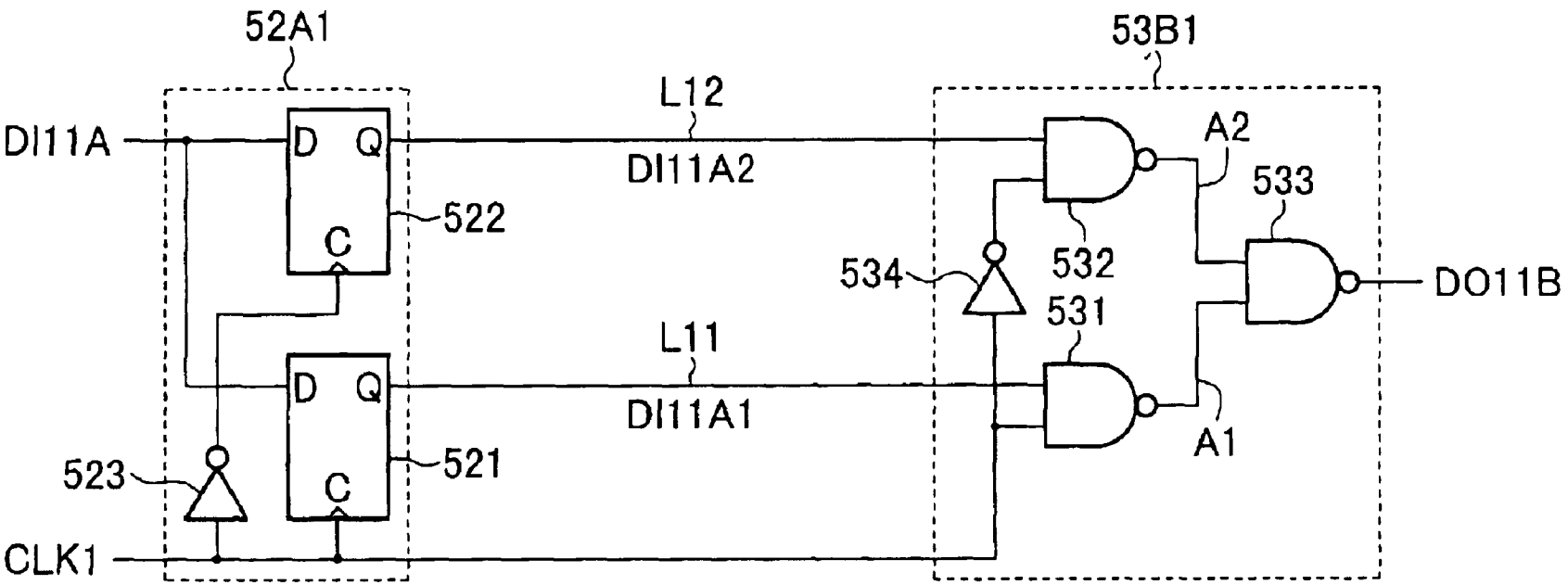
FIG. 5 is a logic circuit diagram showing a configuration corresponding to one bit of an input circuit and an output circuit of FIG. 3.

FIG. 5 shows a configuration corresponding to one bit of the input circuit 52A and the output circuit 53B of FIG. 3.

A decomposing circuit 52A1 and a composing circuit 53B1 are respectively configurations associated with the external input data signal DI11A of the input circuit 52A of FIG. 3 and the external output data signal DO11B of the output circuit 53B of FIG. 3.

The decomposing circuit 52A1 includes D flip-flops 521 and 522 and an inverter 523. The data inputs D of the D flip-flops 521 and 522 commonly receive the external input data signal DI11A, and the clock inputs of the D flip-flops 521 and 522 respectively receive a clock signal CLK1 and its complementary signal inverted by the inverter 523. Non-inverted outputs Q of the D flip-flops 521 and 522 are connected to one ends of signal lines L11 and L12, respectively.

Figure 6:
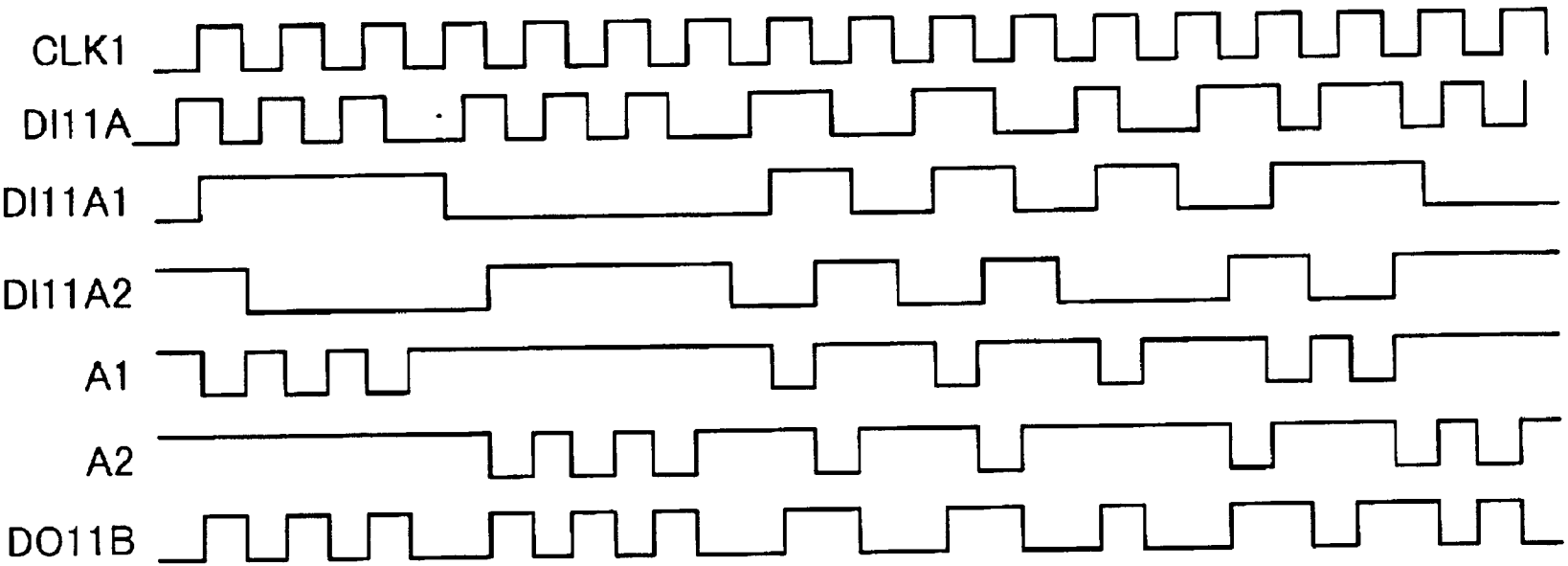
FIG. 6 is a time chart showing an operation of the circuit of FIG. 5.

Because the external input data signal DI11A is latched into the D flip-flops 521 and 522 at rising and falling edges, respectively, of the clock signal CLK1, each of internal data signals DI11A1 and DI11A2 on the signal lines L11 and L12 becomes half the clock signal CLK1 in frequency at the maximum as shown in FIG. 6. Because crosstalk noise between the signal lines L11 and L12 occurs upon change of signal voltage, the crosstalk effect becomes reduced to under a half of the prior art where the data signal is not decomposed.

The composing circuit 53B1 is for regenerating the external input data signal DI11A by combining the decomposed data signals, and includes NAND gates 531 to 533 and an inverter 534. One inputs of the NAND gates 531 and 532 receives the internal data signals DI11A1 and DI11A2, respectively, from the D flip-flops 521 and 522, and the other inputs respectively receive the clock signal CLK1 and its complementary signal inverted by the inverter 534.

Output signals A1 and A2 of the NAND gates 531 and 532 as shown in FIG. 6 are provided to the NAND gate 533, and an external output data signal DO11B as shown in FIG. 6 is output therefrom.

Because the external output data signal DO11B is a retimed signal of the external input data signal DI11A, there is no accumulation of differences of signal propagation delay time due to the length difference between inner and outer data signal lines that are disposed between the data driver ICs 21B to 24B of FIG. 1, and occurrence of timing error can be prevented even if there are a larger number of connections of the data driver IC 21B.

Referring back to FIG. 3, when the transfer direction control signal R/L is 'H', the data signal DATA1 is provided through the I/O buffer circuit 51A to the input circuit 52A, the signals decomposed by the circuit 52A are provided through the signal lines L11 to L14 to the output circuit 53B to compose for regenerating, and it is output as the data signal DATA2 through the I/O buffer circuit 51B. In addition, signals on signal lines L11 to L14 are selected by a multiplexer 57 to provide to the main body circuit 26 of FIG. 1.

When the transfer direction control signal R/L is 'L', the data signal DATA2 is provided through the I/O buffer circuit 51B to the input circuit 52B, the signals decomposed by the circuit 52B are provided through the signal lines L21 to L24 to the output circuit 53A to compose for regenerating, and it is output as the data signal DATA1 through the I/O buffer circuit 51A. In addition, signals on signal lines L21 are selected by the multiplexer 57 to provide to the main body circuit 26 of FIG. 1.

The main body circuit 26 includes at the input stage thereof the same circuit as the output circuit 53A to compose for regenerating, and the other circuits may embodied by the same circuits as the prior art, for example, circuits disclosed in the Japanese patent application No. 2000-333517.

Second Embodiment

Figure 7:
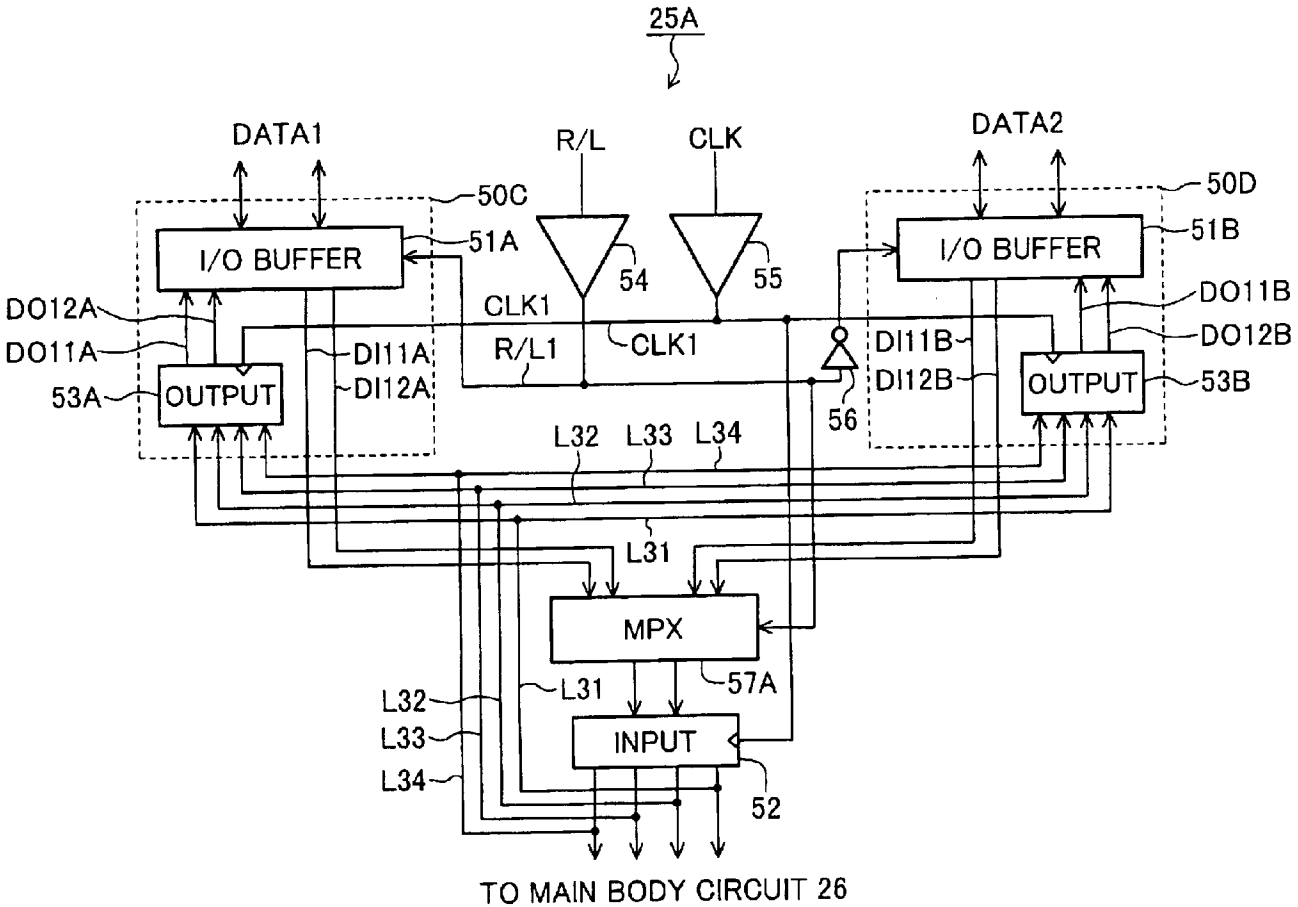
FIG. 7 is a block diagram showing a transfer circuit according to a second embodiment of the present invention.

FIG. 7 is a block diagram showing a transfer circuit 25A according to a second embodiment of the present invention.

In this circuit, the input circuits 52A and 52B of FIG. 3 are omitted by connecting an input circuit 52 to the output of a multiplexer 57A. The input circuit 52 has the same structure as the input circuit 52A of FIG. 3.

The multiplexer 57A selects external input data signals DI11A and DI12A provided from the I/O buffer circuit 51A when the transfer direction control signal R/L is 'H', and external input data signals DI11B and DI12B provided from the I/O buffer circuit 51B when R/L is 'L', and then provides the selected signals to the input circuit 52.

The outputs of the input circuit 52 are connected to first ends of the signal lines L31 to L34, and second and third ends of the signal lines L31 to L34 are connected to the inputs of the output circuits 53A and 53B, respectively.

When the transfer direction control signal R/L is 'H', the data signal DATA1 is provided through the I/O buffer circuit 51A and the multiplexer 57A to the input circuit 52, decomposed into signals under a half in frequency, and provided to the output circuits 53A and 53B. The output of the output circuit 53A is invalid because the input of the I/O buffer circuit 51A that receives it is in a high impedance state. On the other hand, the output signal of the output circuit 53B is output through the I/O buffer circuit 51B.

When the transfer direction control signal R/L is 'L', the data signal DATA2 is provided through the I/O buffer circuit 51B and the multiplexer 57A to the input circuit 52, decomposed into signals under a half in frequency, and provided to the output circuits 53A and 53B. The output of the output circuit 53B is invalid because the input of the I/O buffer circuit 51B that receives it is in a high impedance state. On the other hand, the output signal of the output circuit 53A is output through the I/O buffer circuit 51A.

The relatively long signal lines L31 to L34 between the first and second end side circuits 50C and 50D get small crosstalk effect thanks to the decrease of frequency. On the other hand, Although the external input data signals DI11A and DI12A have the same frequency as the data signal DATA1, because the length of their signal lines is about a half of the distance between the first and second end side circuits 50C and 50D, their crosstalk effects become low. The same applies to the signal lines of the external input data signals DI11B and DI12B.

Third Embodiment

Figure 8:
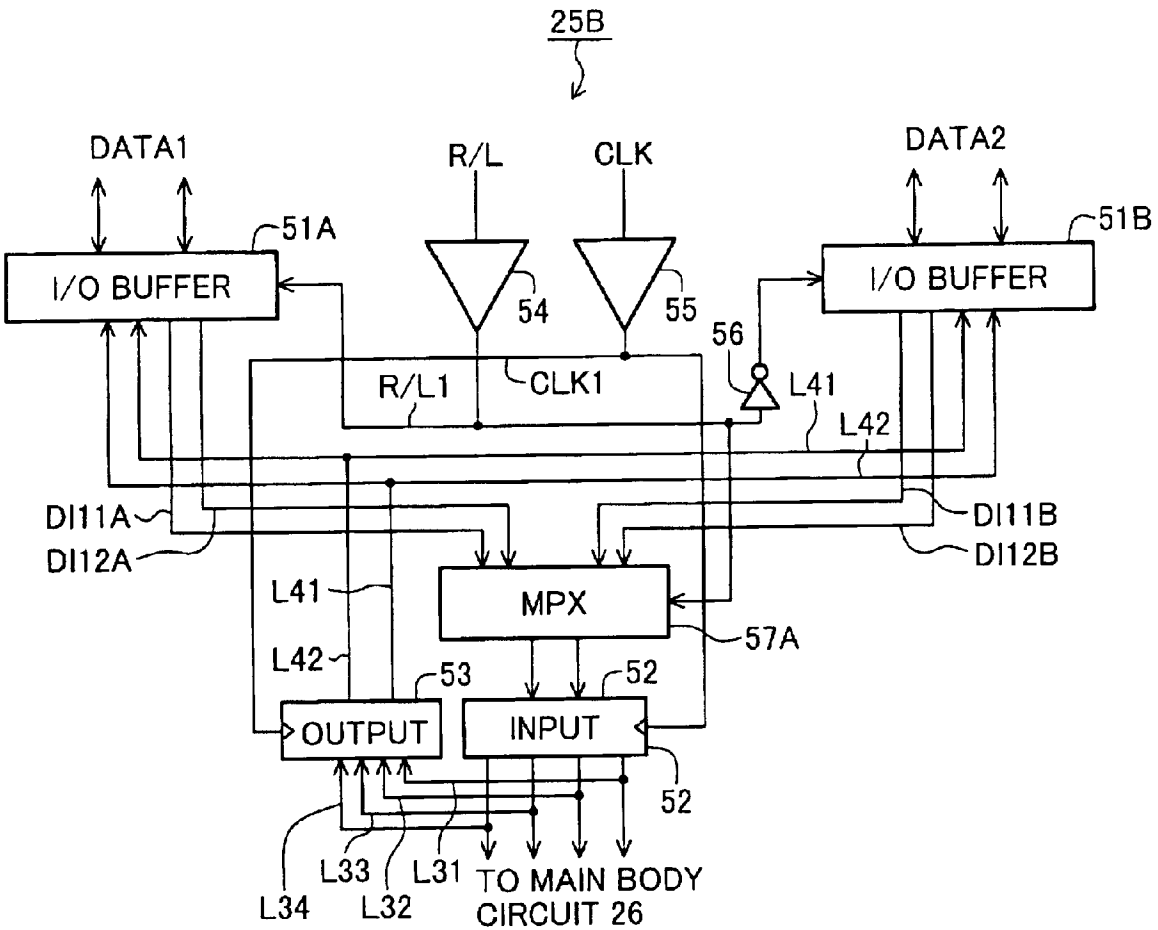
FIG. 8 is a block diagram showing a transfer circuit according to a third embodiment of the present invention.

FIG. 8 is a block diagram showing a transfer circuit 25B according to a third embodiment of the present invention.

In this circuit, the output circuits 53A and 53B of FIG. 7 are omitted by disposing an output circuit 53 on the side of the input circuit 52. The output circuit 53 has the same structure as the output circuit 53A of FIG. 7. The Input of the output circuit 53 is connected to the output of the input circuit 52, the output of the output circuit 53 is connected to first ends of signal lines L41 and L42, and second and third ends of the signal lines L41 and L42 are connected, respectively, to the inputs of the IO buffer circuits 51A and 51B.

Figure 9:
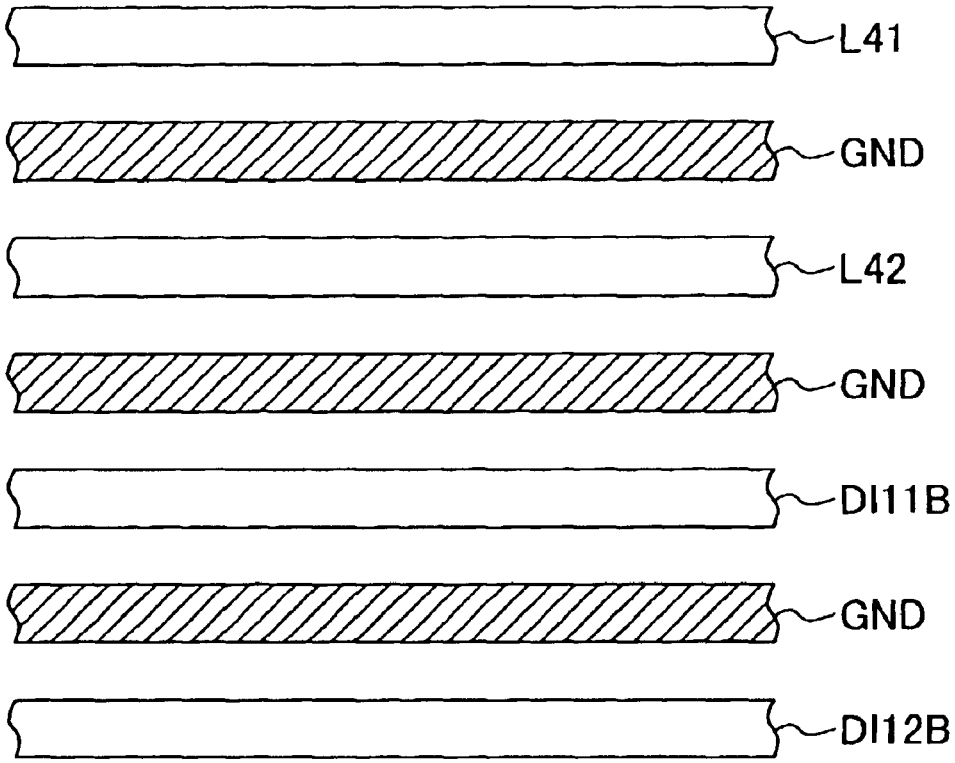
FIG. 9 is a view for illustrating an array of the data signal lines between the I/O buffer circuits 51A and 51B of FIG. 8.

According to the third embodiment, it is possible to make the number of data signal lines smaller than the first and second embodiments, and thereby ground lines GND as shown in FIG. 9 can be easily formed at intervals between the data lines extendedly disposed between the I/O buffer circuits 51A and 51B, which allows the crosstalk effect to be reduced.

Fourth Embodiment

Figure 10:
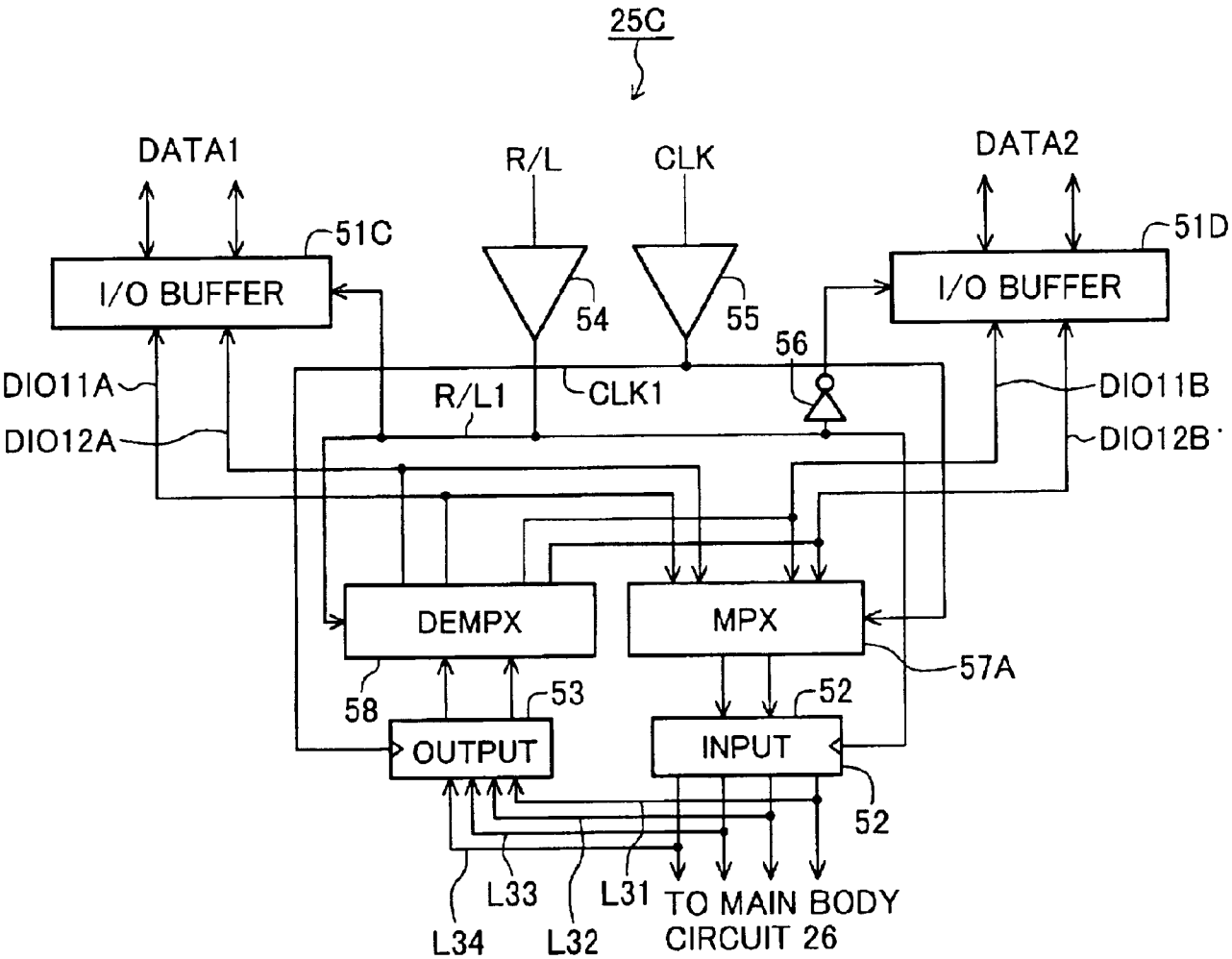
FIG. 10 is a block diagram showing a transfer circuit according to a forth embodiment of the present invention.
Figure 11:
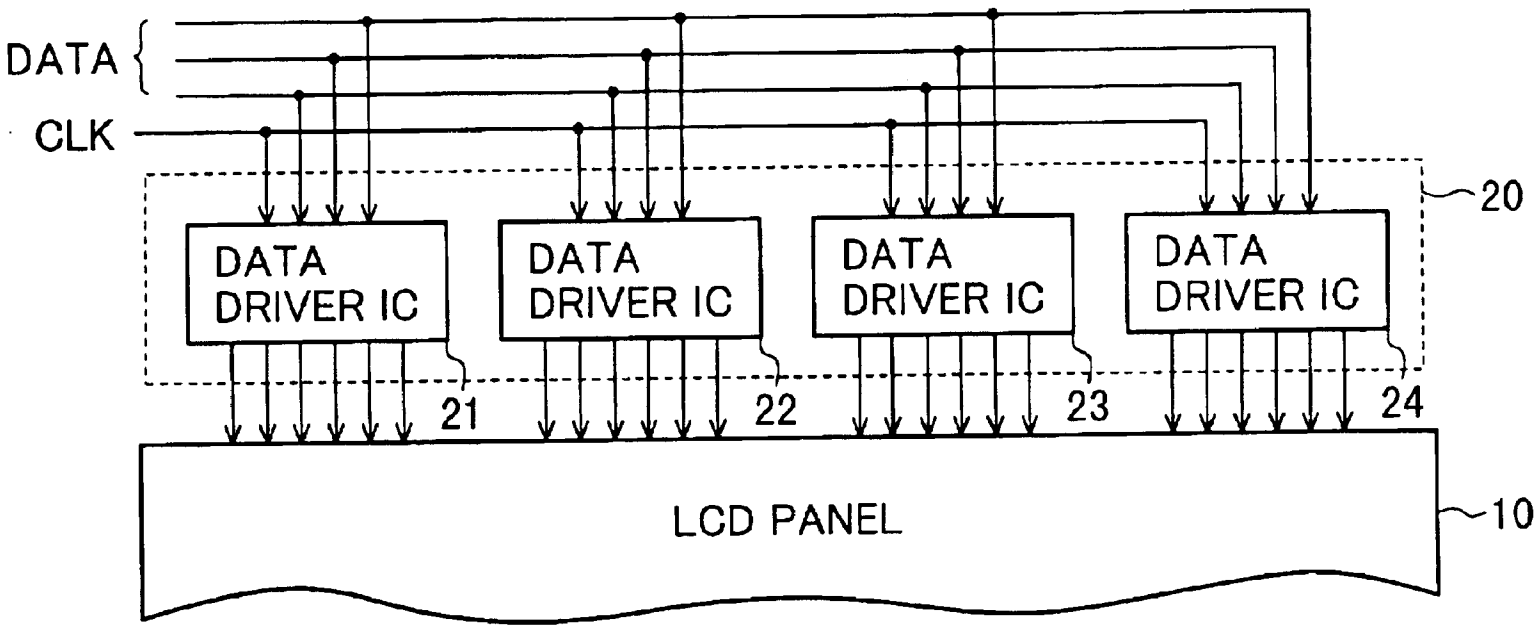
FIG.11 prior art
FIG. 11 is a schematic block diagram showing a configuration of a prior art data driver connected to the data lines of an LCD panel.
Figure 12:
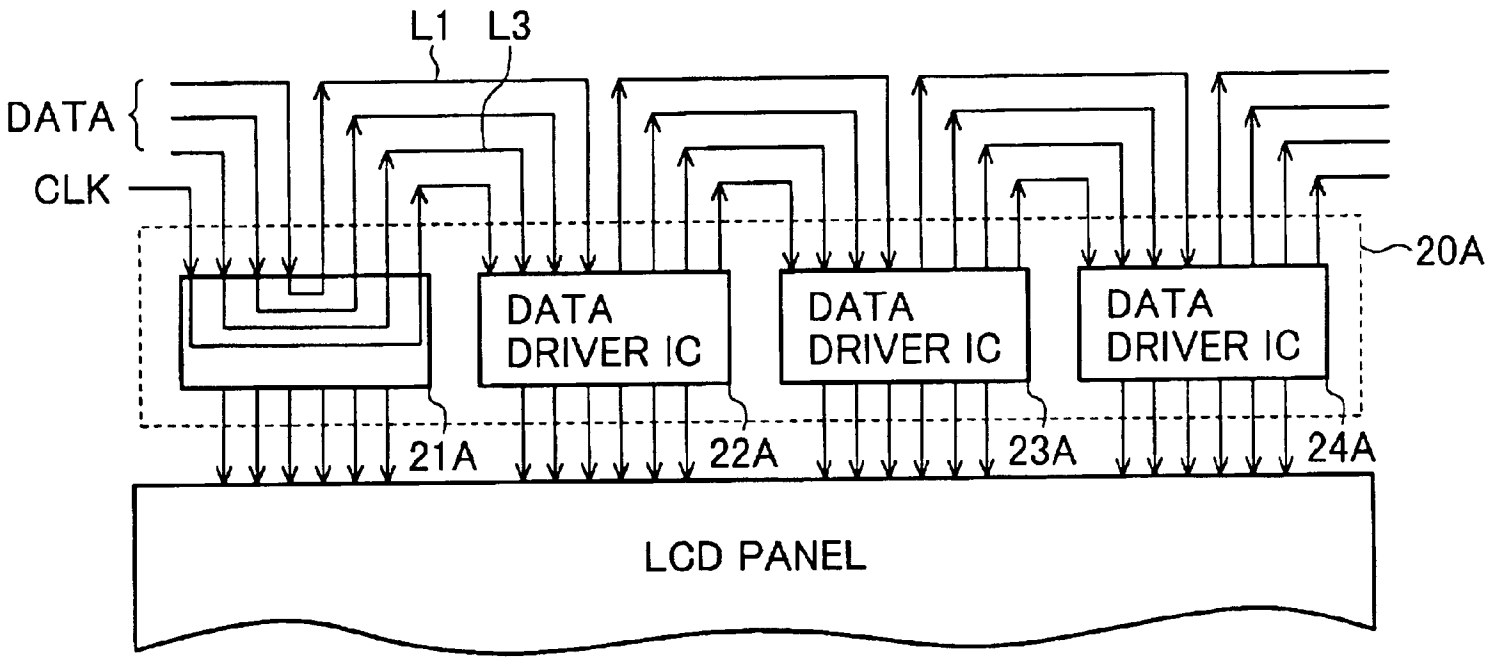
FIG.12 prior art
FIG. 12 is a schematic block diagram showing a configuration of another prior art data driver connected to the data lines of the LCD panel.

FIG. 10 is a block diagram showing a transfer circuit according to a forth embodiment of the present invention.

In this circuit, the chip sides of I/O buffer circuits 51C and 51D are also bidirectional, reducing the number of signal lines to a half of the case of FIG. 8. There is provided a demultiplexer 58 near the output circuit 53, and an output destination of the output circuit 53 is determined according to the transfer direction control signal R/L.

When R/L is 'H', the demultiplexer 58 provides the output of the output circuit 53 to the I/O buffer circuit 51D, while the I/O buffer circuit 51C side output of the demultiplexer 58 is in a high impedance state. When R/L is 'L', the demultiplexer 58 provides the output of the output circuit 53 to the I/O buffer circuit 51C, while the I/O buffer circuit 51D side output of the demultiplexer 58 is in a high impedance state.

According to the fourth embodiment, because the number of data signal lines is smaller, ground lines GND can be easily formed at intervals between the data lines like the third embodiment. In addition, because there is no relatively long data signal line directly connected between the I/O buffer circuits 51C and 51D, the crosstalk effect can be reduced.

Although preferred embodiments of the present invention have been described, it is to be understood that the invention is not limited thereto and that various changes and modifications may be made without departing from the spirit and scope of the invention.

What is claimed is:

1. A semiconductor device comprising:

terminals including a control terminal to receive a transfer direction control signal, a first I/O terminal, and a second I/O terminal;

a transfer circuit configured to, when the transfer direction control signal is in a first state:

receive an external input data signal from the first I/O terminal, decompose the external input data signal into first and second data signals in synchronism with a clock signal so as to reduce frequency of the external input data signal, combine the first and second data signals in synchronism with the clock signal to compose a retimed signal of the external input data signal, and provide the retimed signal as an external output data signal to the second I/O terminal, and further configured to, when the transfer direction control signal is in a second state:

receive an external input data signal from the second I/O terminal, decompose the external input data signal into first and second data signals in synchronism with the clock signal so as to reduce frequency of the external input data signal, compose a retimed signal of the external input data signal on the basis of the first and second data signals in synchronism with the clock signal, and provide the retimed signal as an external output data signal to the first I/O terminal; and a main body circuit to process the external input data signal.

2. The semiconductor device according to claim 1, wherein the transfer circuit comprises:

first and second circuit groups each including:

an input/output buffer circuit having a control input end, an input/output end, an input end, and an output end;

an input circuit having a clock input to receive the clock signal, an input end, and output ends, the input end thereof being connected to the output end of the input/output buffer circuit; and an output circuit having a clock input to receive the clock signal, input ends, and an output end, the output end thereof being connected to the input end of the input/output buffer circuit;

first internal data lines, first ends thereof being connected to the respective output ends of the input circuit of the first circuit group, second ends thereof being connected to the respective input ends of the output circuit of the second circuit group;

second internal data lines, first ends thereof being connected to the respective output ends of the input circuit of the second circuit group, second ends thereof being connected to the respective input ends of the output circuit of the first circuit group; and a multiplexer having a control input to receive the transfer direction control signal, first input ends connected to the respective first internal data lines, second input ends connected to the respective second internal data lines, and output ends connected to the main body circuit;

wherein the first and second circuit groups are disposed on a first I/O terminal side and a second I/O terminal side, respectively, wherein the input/output end of the input/output buffer circuit of the first circuit group is connected to the first I/O terminal, the input/output end of the input/output buffer circuit of the second circuit group is connected to the second I/O terminal, and the control input ends of the input/output buffer circuit of the first and second circuit groups are connected to receive the transfer direction control signal and a complementary signal thereof, respectively, wherein each input/output buffer circuit is configured to provide a signal at the input/output end thereof to the output end thereof when the transfer direction control signal is in a first state, and to provide a signal at the input end thereof to the input/output end thereof when the transfer direction control signal is in a second state, wherein each input circuit is configured to decompose a signal at the input end thereof into the first and second data signals to provide to the output ends thereof, wherein each output circuit is configured to combine signals at the input ends thereof to compose the retimed signal, and to provide the retimed signal to the output end thereof, wherein the multiplexer is configured to select signals on the first or second input ends thereof to provide to the output ends thereof when the transfer direction control signal is in the first or second state, respectively.

3. The semiconductor device according to claim 2, wherein the main body circuit comprises a data driver circuit for a flat display panel.

4. The semiconductor device according to claim 1, wherein the transfer circuit comprises:

first and second circuit groups each including:

an input/output buffer circuit having a control input end, an input/output end, an input end, and an output end; and an output circuit having a clock input to receive the clock signal, input ends, and an output end, the output end thereof being connected to the input end of the input/output buffer circuit;

a third circuit group including:

a multiplexer having a control input to receive the transfer direction control signal, a first input end, a second input end, and an output end; and an input circuit having a clock input to receive the clock signal, an input end connected to the output end of the multiplexer, and an output ends connected to the main body circuit;

a first input data line connected between the output end of the input/output buffer circuit of the first group and the first input of the multiplexer;

a second input data line connected between the output end of the input/output buffer circuit of the second group and the second input of the multiplexer; and output data lines, first ends thereof being connected to the output ends of the input circuit, second ends thereof being connected to the input ends of the output circuit of the first circuit group, third ends thereof being connected to the input ends of the output circuit of the second circuit group, wherein the first and second circuit groups are disposed on a first I/O terminal side and a second I/O terminal side, respectively, and the third circuit group is disposed between the first and second circuit groups, wherein the input/output end of the input/output buffer circuit of the first circuit group is connected to the first I/O terminal, the input/output end of the input/output buffer circuit of the second circuit group is connected to the second I/O terminal, and the control input ends of the input/output buffer circuit of the first and second circuit groups are connected to receive the transfer direction control signal and a complementary signal thereof, respectively, wherein each input/output buffer circuit is configured to provide a signal at the input/output end thereof to the output end thereof when the transfer direction control signal is in a first state, and to provide a signal at the input end thereof to the input/output end thereof when the transfer direction control signal is in a second state, wherein the input circuit is configured to decompose a signal at the input end thereof into the first and second data signals to provide to the output ends thereof, wherein each output circuit is configured to combine signals at the input ends thereof to compose the retimed signal, and to provide the retimed signal to the output end thereof, wherein the multiplexer is configured to select a signal on the first or second input end thereof to provide to the output end thereof when the transfer direction control signal is in the first or second state, respectively.

5. The semiconductor device according to claim 4, wherein the main body circuit comprises a data driver circuit for a flat display panel.

6. The semiconductor device according to claim 1, wherein the transfer circuit comprises:

first and second input/output buffer circuits each having a control input end, an input/output end, an input end, and an output end, the input/output ends of the first and second input/output buffer circuits are connected to the first and second I/O terminals, respectively, and the control input ends of the first and second input/output buffer circuits are connected to receive the transfer direction control signal and a complementary signal thereof, respectively;

a circuit group including:

a multiplexer having a control input to receive the transfer direction control signal, a first input end, a second input end, and an output end;

an input circuit having a clock input to receive the clock signal, an input end connected to the output end of the multiplexer, and an output ends connected to the main body circuit; and an output circuit having a clock input to receive the clock signal, input ends connected to the output ends of the input circuit, and an output end;

a first input data line connected between the output end of the first input/output buffer circuit and the first input of the multiplexer;

a second input data line connected between the output end of the second input/output buffer circuit and the second input of the multiplexer; and an output data line, a first end thereof being connected to the output end of the output circuit, a second end thereof being connected to the input end of the first input/output buffer circuit, third end thereof being connected to the input end of the second input/output buffer circuit, wherein the first and second input/output buffer circuits are disposed on a first I/O terminal side and a second I/O terminal side, respectively, and the circuit group is disposed between the first and second input/output buffer circuits, wherein each input/output buffer circuit is configured to provide a signal at the input/output end thereof to the output end thereof when the transfer direction control signal is in a first state, and to provide a signal at the input end thereof to the input/output end thereof when the transfer direction control signal is in a second state, wherein the input circuit is configured to decompose a signal at the input end thereof into the first and second data signals to provide to the output ends thereof, wherein the output circuit is configured to combine signals at the input ends thereof to compose the retimed signal, and to provide the retimed signal to the output end thereof, wherein the multiplexer is configured to select a signal on the first or second input end thereof to provide to the output end thereof when the transfer direction control signal is in the first or second state, respectively.

7. The semiconductor device according to claim 6, wherein the main body circuit comprises a data driver circuit for a flat display panel.

8. The semiconductor device according to claim 1, wherein the transfer circuit comprises:

first and second input/output buffer circuits each having a control input end, a first input/output end, and a second input/output end, the first input/output ends of the first and second input/output buffer circuits are connected to the first and second I/O terminals, respectively, and the control input ends of the first and second input/output buffer circuits are connected to receive the transfer direction control signal and a complementary signal thereof, respectively;

a circuit group including:

a multiplexer having a control input to receive the transfer direction control signal, a first input end, a second input end, and an output end;

a demultiplexer having a control input to receive the transfer direction control signal, an input end, a first output end, and a second output end, an input circuit having a clock input to receive the clock signal, an input end connected to the output end of the multiplexer, and an output ends connected to the main body circuit; and an output circuit having a clock input to receive the clock signal, input ends connected to the output ends of the input circuit, and an output end connected to the input end of the demultiplexer;

a first input/output data line connected among the input/output end of the first input/output buffer circuit, the first input of the multiplexer, and the first output end of the demultiplexer;

a second input/output data line connected among the input/output end of the second input/output buffer circuit, the second input of the multiplexer, and the second output end of the demultiplexer;

wherein the first and second input/output buffer circuits are disposed on a first I/O terminal side and a second I/O terminal side, respectively, and the circuit group is disposed between the first and second input/output buffer circuits, wherein each input/output buffer circuit is configured to provide a signal at the first input/output end thereof to the second input/output end thereof when the transfer direction control signal is in a first state, and to provide a signal at the second input/output end thereof to the first input/output end thereof when the transfer direction control signal is in a second state, wherein the input circuit is configured to decompose a signal at the input end thereof into the first and second data signals to provide to the output ends thereof, wherein the output circuit is configured to combine signals at the input ends thereof to compose the retimed signal, and to provide the retimed signal to the output end thereof, wherein the multiplexer is configured to select a signal on the first or second input end thereof to provide to the output end thereof when the transfer direction control signal is in the first or second state, respectively;

wherein the demultiplexer is configured to provide a signal at the input end thereof to the first or second output end thereof when the transfer direction control signal is in the second or first state, respectively.

9. The semiconductor device according to claim 8, wherein the main body circuit comprises a data driver circuit for a flat display panel.

10. The semiconductor device according to claim 1, wherein the main body circuit comprises a data driver circuit for a flat display panel.

11. A data driver for a flat-panel display device, comprising:

a printed board; and a plurality of semiconductor devices mounted on the printed board, wherein each semiconductor device comprises:

terminals including a control terminal to receive a transfer direction control signal, a first I/O terminal, and a second I/O terminal;

a transfer circuit configured to, when the transfer direction control signal is in a first state:

receive an external input data signal from the first I/O terminal, decompose the external input data signal into first and second data signals in synchronism with a clock signal so as to reduce frequency of the external input data signal, compose a retimed signal of the external input data signal on the basis of the first and second data signals in synchronism with the clock signal, and provide the retimed signal as an external output data signal to the second I/O terminal, and further configured to, when the transfer direction control signal is in a second state:

receive an external input data signal from the second I/O terminal, decompose the external input data signal into first and second data signals in synchronism with the clock signal so as to reduce frequency of the external input data signal, compose a retimed signal of the external input data signal on the basis of the first and second data signals in synchronism with the clock signal, and provide the retimed signal as an external output data signal to the first I/O terminal; and a data driver circuit to process the external input data signal.

12. The data driver according to claim 11, wherein the transfer circuit comprises:

first and second circuit groups each including:

an input/output buffer circuit having a control input end, an input/output end, an input end, and an output end;

an input circuit having a clock input to receive the clock signal, an input end, and output ends, the input end thereof being connected to the output end of the input/output buffer circuit; and an output circuit having a clock input to receive the clock signal, input ends, and an output end, the output end thereof being connected to the input end of the input/output buffer circuit;

first internal data lines, first ends thereof being connected to the respective output ends of the input circuit of the first circuit group, second ends thereof being connected to the respective input ends of the output circuit of the second circuit group;

second internal data lines, first ends thereof being connected to the respective output ends of the input circuit of the second circuit group, second ends thereof being connected to the respective input ends of the output circuit of the first circuit group; and a multiplexer having a control input to receive the transfer direction control signal, first input ends connected to the respective first internal data lines, second input ends connected to the respective second internal data lines, and output ends connected to the main body circuit;

wherein the first and second circuit groups are disposed on a first I/O terminal side and a second I/O terminal side, respectively, wherein the input/output end of the input/output buffer circuit of the first circuit group is connected to the first I/O terminal, the input/output end of the input/output buffer circuit of the second circuit group is connected to the second I/O terminal, and the control input ends of the input/output buffer circuit of the first and second circuit groups are connected to receive the transfer direction control signal and a complementary signal thereof, respectively, wherein each input/output buffer circuit is configured to provide a signal at the input/output end thereof to the output end thereof when the transfer direction control signal is in a first state, and to provide a signal at the input end thereof to the input/output end thereof when the transfer direction control signal is in a second state, wherein each input circuit is configured to decompose a signal at the input end thereof into the first and second data signals to provide to the output ends thereof, wherein each output circuit is configured to combine signals at the input ends thereof to compose the retimed signal, and to provide the retimed signal to the output end thereof, wherein the multiplexer is configured to select signals on the first or second input ends thereof to provide to the output ends thereof when the transfer direction control signal is in the first or second state, respectively.

13. The data driver according to claim 11, wherein the transfer circuit comprises:

first and second circuit groups each including:

an input/output buffer circuit having a control input end, an input/output end, an input end, and an output end; and an output circuit having a clock input to receive the clock signal, input ends, and an output end, the output end thereof being connected to the input end of the input/output buffer circuit;

a third circuit group including:

a multiplexer having a control input to receive the transfer direction control signal, a first input end, a second input end, and an output end; and an input circuit having a clock input to receive the clock signal, an input end connected to the output end of the multiplexer, and an output ends connected to the main body circuit;

a first input data line connected between the output end of the input/output buffer circuit of the first group and the first input of the multiplexer;

a second input data line connected between the output end of the input/output buffer circuit of the second group and the second input of the multiplexer; and output data lines, first ends thereof being connected to the output ends of the input circuit, second ends thereof being connected to the input ends of the output circuit of the first circuit group, third ends thereof being connected to the input ends of the output circuit of the second circuit group, wherein the first and second circuit groups are disposed on a first I/O terminal side and a second I/O terminal side, respectively, and the third circuit group is disposed between the first and second circuit groups, wherein the input/output end of the input/output buffer circuit of the first circuit group is connected to the first I/O terminal, the input/output end of the input/output buffer circuit of the second circuit group is connected to the second I/O terminal, and the control input ends of the input/output buffer circuit of the first and second circuit groups are connected to receive the transfer direction control signal and a complementary signal thereof, respectively, wherein each input/output buffer circuit is configured to provide a signal at the input/output end thereof to the output end thereof when the transfer direction control signal is in a first state, and to provide a signal at the input end thereof to the input/output end thereof when the transfer direction control signal is in a second state, wherein the input circuit is configured to decompose a signal at the input end thereof into the first and second data signals to provide to the output ends thereof, wherein each output circuit is configured to combine signals at the input ends thereof to compose the retimed signal, and to provide the retimed signal to the output end thereof, wherein the multiplexer is configured to select a signal on the first or second input end thereof to provide to the output end thereof when the transfer direction control signal is in the first or second state, respectively.

14. The data driver according to claim 11, wherein the transfer circuit comprises:

first and second input/output buffer circuits each having a control input end, an input/output end, an input end, and an output end, the input/output ends of the first and second input/output buffer circuits are connected to the first and second I/O terminals, respectively, and the control input ends of the first and second input/output buffer circuits are connected to receive the transfer direction control signal and a complementary signal thereof, respectively;

a circuit group including:

a multiplexer having a control input to receive the transfer direction control signal, a first input end, a second input end, and an output end;

an input circuit having a clock input to receive the clock signal, an input end connected to the output end of the multiplexer, and an output ends connected to the main body circuit; and an output circuit having a clock input to receive the clock signal, input ends connected to the output ends of the input circuit, and an output end;

a first input data line connected between the output end of the first input/output buffer circuit and the first input of the multiplexer;

a second input data line connected between the output end of the second input/output buffer circuit and the second input of the multiplexer; and an output data line, a first end thereof being connected to the output end of the output circuit, a second end thereof being connected to the input end of the first input/output buffer circuit, third end thereof being connected to the input end of the second input/output buffer circuit, wherein the first and second input/output buffer circuits are disposed on a first I/O terminal side and a second I/O terminal side, respectively, and the circuit group is disposed between the first and second input/output buffer circuits, wherein each input/output buffer circuit is configured to provide a signal at the input/output end thereof to the output end thereof when the transfer direction control signal is in a first state, and to provide a signal at the input end thereof to the input/output end thereof when the transfer direction control signal is in a second state, wherein the input circuit is configured to decompose a signal at the input end thereof into the first and second data signals to provide to the output ends thereof, wherein the output circuit is configured to combine signals at the input ends thereof to compose the retimed signal, and to provide the retimed signal to the output end thereof, wherein the multiplexer is configured to select a signal on the first or second input end thereof to provide to the output end thereof when the transfer direction control signal is in the first or second state, respectively.

15. The data driver according to claim 11, wherein the transfer circuit comprises:

first and second input/output buffer circuits each having a control input end, a first input/output end, and a second input/output end, the first input/output ends of the first and second input/output buffer circuits are connected to the first and second I/O terminals, respectively, and the control input ends of the first and second input/output buffer circuits are connected to receive the transfer direction control signal and a complementary signal thereof, respectively;

a circuit group including:

a multiplexer having a control input to receive the transfer direction control signal, a first input end, a second input end, and an output end;

a demultiplexer having a control input to receive the transfer direction control signal, an input end, a first output end, and a second output end, an input circuit having a clock input to receive the clock signal, an input end connected to the output end of the multiplexer, and an output ends connected to the main body circuit; and an output circuit having a clock input to receive the clock signal, input ends connected to the output ends of the input circuit, and an output end connected to the input end of the demultiplexer;

a first input/output data line connected among the input/output end of the first input/output buffer circuit, the first input of the multiplexer, and the first output end of the demultiplexer;

a second input/output data line connected among the input/output end of the second input/output buffer circuit, the second input of the multiplexer, and the second output end of the demultiplexer;

wherein the first and second input/output buffer circuits are disposed on a first I/O terminal side and a second I/O terminal side, respectively, and the circuit group is disposed between the first and second input/output buffer circuits, wherein each input/output buffer circuit is configured to provide a signal at the first input/output end thereof to the second input/output end thereof when the transfer direction control signal is in a first state, and to provide a signal at the second input/output end thereof to the first input/output end thereof when the transfer direction control signal is in a second state, wherein the input circuit is configured to decompose a signal at the input end thereof into the first and second data signals to provide to the output ends thereof, wherein the output circuit is configured to combine signals at the input ends thereof to compose the retimed signal, and to provide the retimed signal to the output end thereof, wherein the multiplexer is configured to select a signal on the first or second input end thereof to provide to the output end thereof when the transfer direction control signal is in the first or second state, respectively;

wherein the demultiplexer is configured to provide a signal at the input end thereof to the first or second output end thereof when the transfer direction control signal is in the second or first state, respectively.

16. A flat-panel display device, comprising:

a flat display panel including data line electrodes and scan line electrodes;

a data driver coupled to the data line electrodes; and a scan driver coupled to the scan line electrodes, wherein the data driver comprises:

a printed board; and a plurality of semiconductor devices mounted on the printed board, wherein each semiconductor device comprises:

terminals including a control terminal to receive a transfer direction control signal, a first I/O terminal, and a second I/O terminal;

a transfer circuit configured to, when the transfer direction control signal is in a first state:

receive an external input data signal from the first I/O terminal, decompose the external input data signal into first and second data signals in synchronism with a clock signal so as to reduce frequency of the external input data signal, compose a retimed signal of the external input data signal on the basis of the first and second data signals in synchronism with the clock signal, and provide the retimed signal as an external output data signal to the second I/O terminal, and further configured to, when the transfer direction control signal is in a second state:

receive an external input data signal from the second I/O terminal, decompose the external input data signal into first and second data signals in synchronism with the clock signal so as to reduce frequency of the external input data signal, compose a retimed signal of the external input data signal on the basis of the first and second data signals in synchronism with the clock signal, and provide the retimed signal as an external output data signal to the first I/O terminal; and a data driver circuit to process the external input data signal.

17. The flat-panel display device of claim 16, wherein the transfer circuit of each semiconductor device comprises:

first and second circuit groups each including:

an input/output buffer circuit having a control input end, an input/output end, an input end, and an output end;

an input circuit having a clock input to receive the clock signal, an input end, and output ends, the input end thereof being connected to the output end of the input/output buffer circuit; and an output circuit having a clock input to receive the clock signal, input ends, and an output end, the output end thereof being connected to the input end of the input/output buffer circuit;

first internal data lines, first ends thereof being connected to the respective output ends of the input circuit of the first circuit group, second ends thereof being connected to the respective input ends of the output circuit of the second circuit group;

second internal data lines, first ends thereof being connected to the respective output ends of the input circuit of the second circuit group, second ends thereof being connected to the respective input ends of the output circuit of the first circuit group; and a multiplexer having a control input to receive the transfer direction control signal, first input ends connected to the respective first internal data lines, second input ends connected to the respective second internal data lines, and output ends connected to the data driver circuit;

wherein the first and second circuit groups are disposed on a first I/O terminal side and a second I/O terminal side, respectively, wherein the input/output end of the input/output buffer circuit of the first circuit group is connected to the first I/O terminal, the input/output end of the input/output buffer circuit of the second circuit group is connected to the second I/O terminal, and the control input ends of the input/output buffer circuit of the first and second circuit groups are connected to receive the transfer direction control signal and a complementary signal thereof, respectively, wherein each input/output buffer circuit is configured to provide a signal at the input/output end thereof to the output end thereof when the transfer direction control signal is in a first state, and to provide a signal at the input end thereof to the input/output end thereof when the transfer direction control signal is in a second state, wherein each input circuit is configured to decompose a signal at the input end thereof into the first and second data signals to provide to the output ends thereof, wherein each output circuit is configured to combine signals at the input ends thereof to compose the retimed signal, and to provide the retimed signal to the output end thereof, wherein the multiplexer is configured to select signals on the first or second input ends thereof to provide to the output ends thereof when the transfer direction control signal is in the first or second state, respectively.

18. The flat-panel display device of claim 16, wherein the transfer circuit of each semiconductor device comprises:

first and second circuit groups each including:

an input/output buffer circuit having a control input end, an input/output end, an input end, and an output end; and an output circuit having a clock input to receive the clock signal, input ends, and an output end, the output end thereof being connected to the input end of the input/output buffer circuit;

a third circuit group including:

a multiplexer having a control input to receive the transfer direction control signal, a first input end, a second input end, and an output end; and an input circuit having a clock input to receive the clock signal, an input end connected to the output end of the multiplexer, and an output ends connected to the data driver circuit;

a first input data line connected between the output end of the input/output buffer circuit of the first group and the first input of the multiplexer;

a second input data line connected between the output end of the input/output buffer circuit of the second group and the second input of the multiplexer; and output data lines, first ends thereof being connected to the output ends of the input circuit, second ends thereof being connected to the input ends of the output circuit of the first circuit group, third ends thereof being connected to the input ends of the output circuit of the second circuit group, wherein the first and second circuit groups are disposed on a first I/O terminal side and a second I/O terminal side, respectively, and the third circuit group is disposed between the first and second circuit groups, wherein the input/output end of the input/output buffer circuit of the first circuit group is connected to the first I/O terminal, the input/output end of the input/output buffer circuit of the second circuit group is connected to the second I/O terminal, and the control input ends of the input/output buffer circuit of the first and second circuit groups are connected to receive the transfer direction control signal and a complementary signal thereof, respectively, wherein each input/output buffer circuit is configured to provide a signal at the input/output end thereof to the output end thereof when the transfer direction control signal is in a first state, and to provide a signal at the input end thereof to the input/output end thereof when the transfer direction control signal is in a second state, wherein the input circuit is configured to decompose a signal at the input end thereof into the first and second data signals to provide to the output ends thereof, wherein each output circuit is configured to combine signals at the input ends thereof to compose the retimed signal, and to provide the retimed signal to the output end thereof, wherein the multiplexer is configured to select a signal on the first or second input end thereof to provide to the output end thereof when the transfer direction control signal is in the first or second state, respectively.

19. The flat-panel display device of claim 16, wherein the transfer circuit of each semiconductor device comprises:

first and second input/output buffer circuits each having a control input end, an input/output end, an input end, and an output end, the input/output ends of the first and second input/output buffer circuits are connected to the first and second I/O terminals, respectively, and the control input ends of the first and second input/output buffer circuits are connected to receive the transfer direction control signal and a complementary signal thereof, respectively;

a circuit group including:

a multiplexer having a control input to receive the transfer direction control signal, a first input end, a second input end, and an output end;

an input circuit having a clock input to receive the clock signal, an input end connected to the output end of the multiplexer, and an output ends connected to the data driver circuit; and an output circuit having a clock input to receive the clock signal, input ends connected to the output ends of the input circuit, and an output end;

a first input data line connected between the output end of the first input/output buffer circuit and the first input of the multiplexer;

a second input data line connected between the output end of the second input/output buffer circuit and the second input of the multiplexer; and an output data line, a first end thereof being connected to the output end of the output circuit, a second end thereof being connected to the input end of the first input/output buffer circuit, third end thereof being connected to the input end of the second input/output buffer circuit, wherein the first and second input/output buffer circuits are disposed on a first I/O terminal side and a second I/O terminal side, respectively, and the circuit group is disposed between the first and second input/output buffer circuits, wherein each input/output buffer circuit is configured to provide a signal at the input/output end thereof to the output end thereof when the transfer direction control signal is in a first state, and to provide a signal at the input end thereof to the input/output end thereof when the transfer direction control signal is in a second state, wherein the input circuit is configured to decompose a signal at the input end thereof into the first and second data signals to provide to the output ends thereof, wherein the output circuit is configured to combine signals at the input ends thereof to compose the retimed signal, and to provide the retimed signal to the output end thereof, wherein the multiplexer is configured to select a signal on the first or second input end thereof to provide to the output end thereof when the transfer direction control signal is in the first or second state, respectively.

20. The flat-panel display device of claim 16, wherein the transfer circuit of each semiconductor device comprises:

first and second input/output buffer circuits each having a control input end, a first input/output end, and a second input/output end, the first input/output ends of the first and second input/output buffer circuits are connected to the first and second I/O terminals, respectively, and the control input ends of the first and second input/output buffer circuits are connected to receive the transfer direction control signal and a complementary signal thereof, respectively;

a circuit group including:

a multiplexer having a control input to receive the transfer direction control signal, a first input end, a second input end, and an output end;

a demultiplexer having a control input to receive the transfer direction control signal, an input end, a first output end, and a second output end, an input circuit having a clock input to receive the clock signal, an input end connected to the output end of the multiplexer, and an output ends connected to the data driver circuit; and an output circuit having a clock input to receive the clock signal, input ends connected to the output ends of the input circuit, and an output end connected to the input end of the demultiplexer;

a first input/output data line connected among the input/output end of the first input/output buffer circuit, the first input of the multiplexer, and the first output end of the demultiplexer;

a second input/output data line connected among the input/output end of the second input/output buffer circuit, the second input of the multiplexer, and the second output end of the demultiplexer;

wherein the first and second input/output buffer circuits are disposed on a first I/O terminal side and a second I/O terminal side, respectively, and the circuit group is disposed between the first and second input/output buffer circuits, wherein each input/output buffer circuit is configured to provide a signal at the first input/output end thereof to the second input/output end thereof when the transfer direction control signal is in a first state, and to provide a signal at the second input/output end thereof to the first input/output end thereof when the transfer direction control signal is in a second state, wherein the input circuit is configured to decompose a signal at the input end thereof into the first and second data signals to provide to the output ends thereof, wherein the output circuit is configured to combine signals at the input ends thereof to compose the retimed signal, and to provide the retimed signal to the output end thereof, wherein the multiplexer is configured to select a signal on the first or second input end thereof to provide to the output end thereof when the transfer direction control signal is in the first or second state, respectively;

wherein the demultiplexer is configured to provide a signal at the input end thereof to the first or second output end thereof when the transfer direction control signal is in the second or first state, respectively.

* * * * *